US012006950B1

(12) United States Patent
Chang

(10) Patent No.: US 12,006,950 B1
(45) Date of Patent: Jun. 11, 2024

(54) COMBINATION STRUCTURE OF FAN GUARD AND STATIC BLADES

(71) Applicant: DELTA ELECTRONICS, INC., Taoyuan (TW)

(72) Inventor: Shun-Chen Chang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/505,958

(22) Filed: Nov. 9, 2023

(30) Foreign Application Priority Data

Jun. 13, 2023 (CN) ..... 202310696540.7

(51) Int. Cl.

| | |
|---|---|
| ***F04D 29/54*** | (2006.01) |
| ***F04D 19/00*** | (2006.01) |
| ***F04D 25/08*** | (2006.01) |
| ***F04D 29/66*** | (2006.01) |
| ***F04D 29/70*** | (2006.01) |

(52) U.S. Cl.
CPC ..... *F04D 29/542* (2013.01); *F04D 29/544* (2013.01); *F04D 29/703* (2013.01); *F04D 19/002* (2013.01); *F04D 25/08* (2013.01); *F04D 29/663* (2013.01)

(58) Field of Classification Search
CPC .... F04D 29/703; F04D 29/542; F04D 29/544; F04D 19/002; F04D 29/663; F04D 25/08
See application file for complete search history.

(56) References Cited

U.S. PATENT DOCUMENTS 6,099,258 A * 8/2000 Litvin ..... F04D 29/703 415/214.1
2013/0022479 A1 1/2013 Haaf et al.
2013/0045085 A1 2/2013 Frank et al.
(Continued)

FOREIGN PATENT DOCUMENTS

DE 202015002378 U1 * 6/2015
EP 1895166 A1 * 3/2008
(Continued)

OTHER PUBLICATIONS

English machine translation of DE 20 2015 002 378 U1, Mar. 14, 2024.*
(Continued)

*Primary Examiner* — Christopher Verdier
(74) *Attorney, Agent, or Firm* — Chun-Ming Shih; HDLS IPR SERVICES

(57) ABSTRACT

A combination structure of a fan guard and static blades is disclosed. The fan guard includes an annular plate, multiple radial ribs, and multiple circumferential ribs. The annular plate is fixed on a motor base. The radial ribs arranged around the annular plate extend radially. The circumferential ribs are arranged concentrically and spacedly and connected with radial ribs in series. Each of the static blades includes a blade body, an inner and an outer coupling plate. The inner coupling plate and the outer coupling plate are arranged on two ends of the blade body respectively. The blade body is fixed on one side of the fan guard through the inner coupling plate being combined with one end of the radial rib and through the outer coupling plate being combined with another end of the radial rib to make the static blades be combined on the fan guard.

10 Claims, 14 Drawing Sheets

(56) References Cited

U.S. PATENT DOCUMENTS

| | | | | |
|---|---|---|---|---|
| 2015/0330411 | A1 | 11/2015 | Heli | |
| 2017/0356673 | A1* | 12/2017 | Gauss | F04D 29/703 |
| 2017/0370380 | A1* | 12/2017 | Beck | F04D 29/601 |

FOREIGN PATENT DOCUMENTS

| | | | |
|---|---|---|---|
| EP | 2133574 | A2 * | 12/2009 |
| WO | 2022062832 | A1 | 3/2022 |

OTHER PUBLICATIONS

English machine translation of EP 2133574-A2, Mar. 14, 2024.*
English machine translation of EP-1895166-A1, Mar. 14, 2024.*

* cited by examiner

COMBINATION STRUCTURE OF FAN GUARD AND STATIC BLADES

BACKGROUND OF THE DISCLOSURE

Technical Field

The technical field relates to a fan device, and more particularly relates to an axial fan device with static blades.

Description of Related Art

A heat dissipation fan is a common heat dissipation device. Generally, a fan device includes a motor, a hub, and a plurality of blades arranged around the hub. The motor drives the hub to rotate, and the blades push the fluid to generate an air flow.

In order to enhance the operation efficiency, the fan device, especially an axial fan, can be equipped with a plurality of static blades to increase the air pressure and air volume, and reduce the noise being generated during operation. Moreover, the static blades of most fan devices are fixed on the motor base. However, the assembly structure of the static blades is complicated, and the thickness of the motor base can be increased. As a result, the overall volume and cost of the fan devices can be increased.

In view of the above drawbacks, the inventor proposes this disclosure based on his expert knowledge and elaborate researches in order to solve the problems of related art.

SUMMARY OF THE DISCLOSURE

This disclosure is a combination structure of a fan guard and static blades, which the static blades are combined with the fan guard to improve the efficiency and reduce noise.

This disclosure is a combination structure of a fan guard and static blades. The fan guard includes an annular plate, a plurality of radial ribs and a plurality of circumferential ribs. The annular plate is fixed on a motor base. The plurality of radial ribs extends radially and are arranged around the annular plate in a radial manner. The circumferential ribs are arranged concentrically and spacedly and connected with the plurality of radial ribs in series. Each of the static blades includes a blade body, an inner coupling plate and an outer coupling plate. The inner coupling plate and the outer coupling plate are arranged on two ends of the blade body, respectively.

The blade body is fixed on one side of the fan guard through the inner coupling plate being combined with one end of one radial rib and through the outer coupling plate being combined with another end of the radial rib to make the plurality of static blades be combined on the fan guard in the radial manner.

In comparison with the related art, the static blade of this disclosure includes a blade body, an inner coupling plate and an outer coupling plate disposed on two ends of the blade body. The static blades and the fan guard may be combined or separated depending on requirements. Furthermore, the blade body is fixed on one side of the fan guard through the inner coupling plate being combined with one end of one radial rib and through the outer coupling plate being combined with another end of the radial rib. Accordingly, the static blades are combined with the fan guard, and the static blades are arranged in a radial manner to be combined on the fan guard. Moreover, comparing the characteristic curves between the fan device with static blades of this disclosure and the fan device without static blades, the characteristic curve of the fan device with static blades of this disclosure can provide a higher air pressure and air volume under the same power, and the noise caused by increasing the rotation speed can be avoided.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
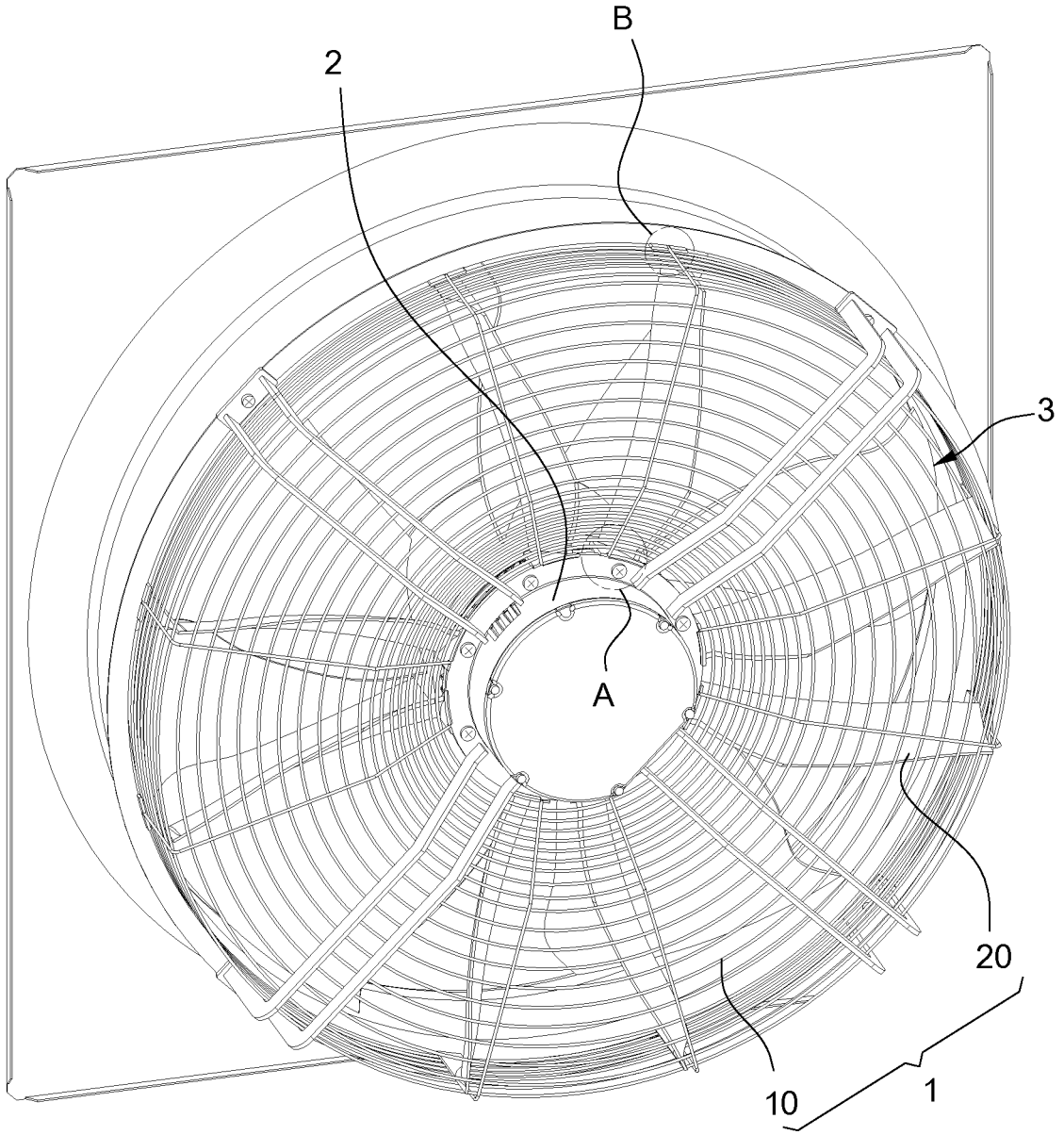
FIG. 1 is a perspective schematic view of the combination structure of a fan guard and static blades in this disclosure.

Please refer to FIG. 1, which is a perspective schematic view of the combination structure of a fan guard 10 and static blades 20 in this disclosure. This disclosure is a combination structure 1 of a fan guard 10 and a plurality of static blades 20. The static blades 20 are arranged in a radial manner to be combined on the fan guard 10. Moreover, the fan guard 10 is combined with the static blades 20 and arranged on the downstream side (air outlet side) of the impeller 3 driven by the motor 2. The air pressure and efficiency of the impeller 3 can be increased by the arrangement of the static blades 20, and the noise during operation can be reduced.

Figure 2:
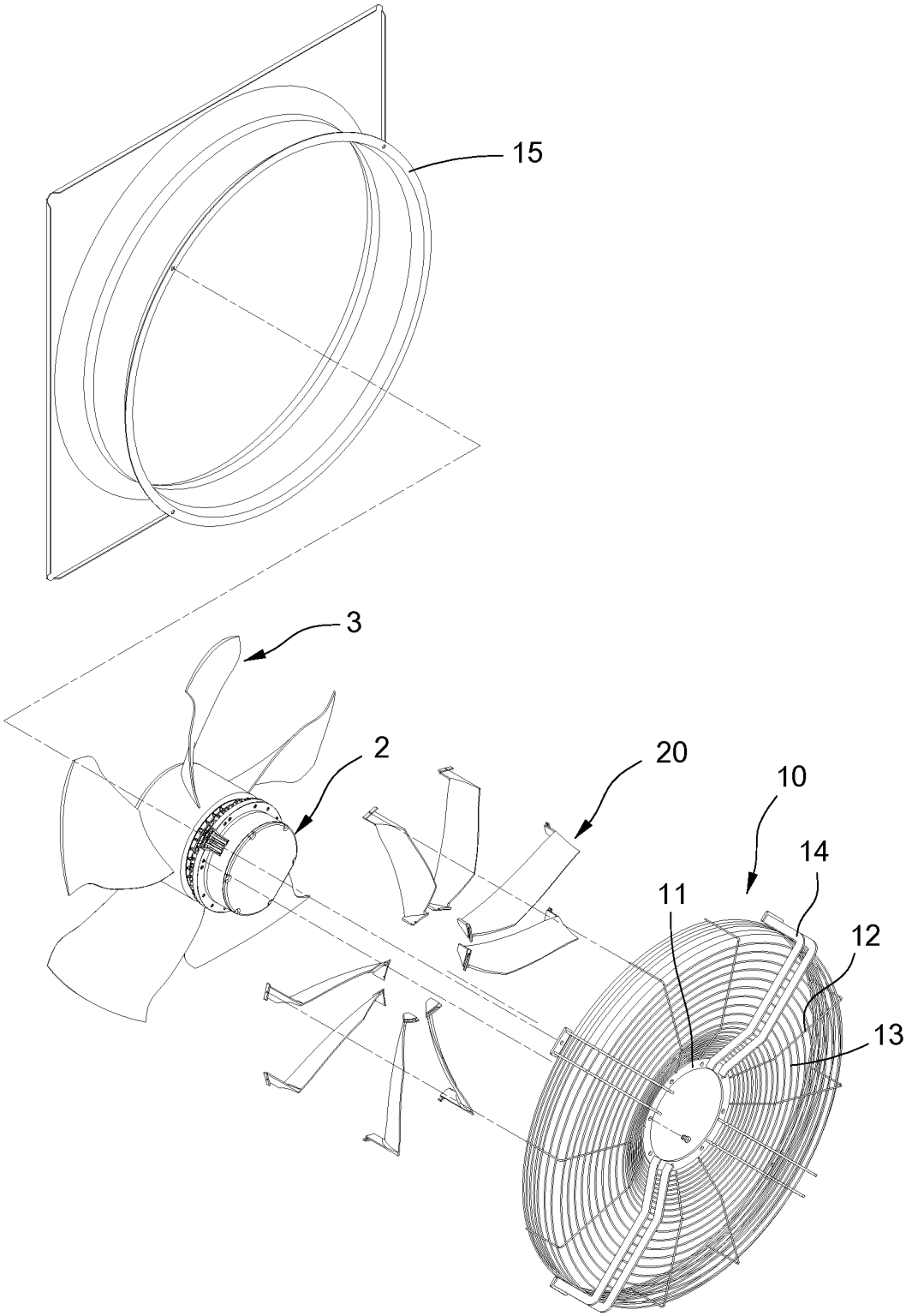
FIG. 2 is a perspective exploded schematic view of the combination structure of a fan guard and static blades in this disclosure.

Please refer to FIG. 2, which is a perspective exploded schematic view of the combination structure of a fan guard 10 and static blades 20 in this disclosure. The fan guard 10 includes an annular plate 11, a plurality of radial ribs 12 and a plurality of circumferential ribs 13. The plurality of radial ribs 12 are extended radially and arranged around the annular plate 11 in a radial manner. The circumferential ribs 13 are arranged concentrically and spacedly and connected with the plurality of radial ribs in series. The static blades 20 are fixed on two ends of the radial ribs 12 correspondingly, and the plurality of static blades 20 are arranged in a radial manner to be combined on the fan guard 10. The fan guard 10 combined with static blades 20 is arranged on the air outlet side of the impeller 3. The motor 2 drives the impeller 3 to rotate and generate a forced air flow. In this embodiment, the impeller 3 is an axial fan.

In one embodiment of this disclosure, the fan guard 10 further includes a plurality of supporting rods 14 and an outer frame 15. The outer frame 15 surrounds and is located on the outermost side of the circumferential ribs 13 to be connected with one ends of the supporting rods 14. The other ends of the supporting rods 14 are connected with the annular plate 11 of the fan guard 10.

Figure 3:
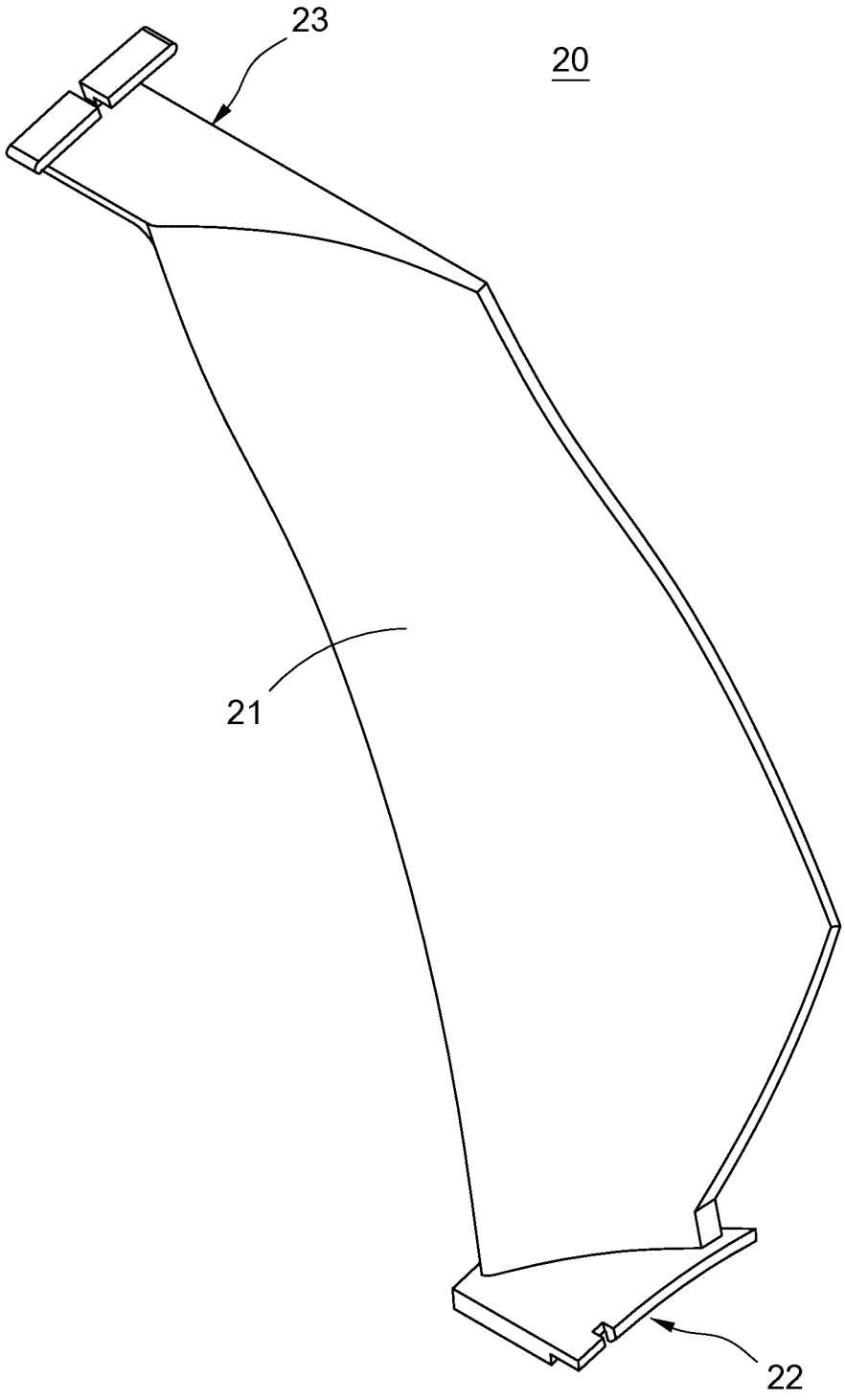
FIG. 3 is a perspective schematic view of the static blade in this disclosure.

Please refer to FIG. 3, which is a perspective schematic view of the static blade 20 in this disclosure. Each of the static blades 20 of this disclosure includes a blade body 21, an inner coupling plate 22 and an outer coupling plate 23. The inner coupling plate 22 and the outer coupling plate 23 are arranged on two ends of the blade body 21, respectively. Generally, the blade body 21, the inner coupling plate 22 and the outer coupling plate 23 are integrally formed in a one-piece form by injection molding.

Figure 4:
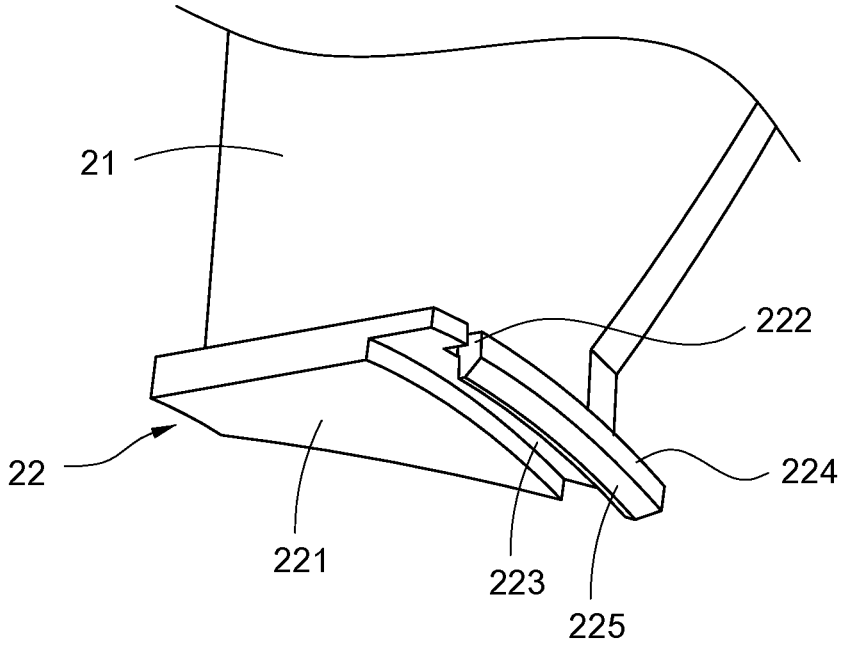
FIG. 4 is a perspective schematic view of the inner coupling plate of the static blade in this disclosure.

Please refer to FIG. 4, which is a perspective schematic view of the inner coupling plate 22 of the static blade 20 in this disclosure. The inner coupling plate 22 includes an inner flap 221, an inner groove 222 and a slot 223. The inner flap 221 is connected to an inner end of the blade body 21 and extends curvedly. The inner groove 222 is disposed on one side of the inner flap 221. Specifically, the inner groove 222 is disposed on a side of the slot 223 and communicates with the slot 223. Additionally, the slot 223 is disposed on a lateral side of the inner flap 221. The inner coupling plate 22 further includes a blocking wall 224 located on a side of the slot 223, and a chamfer 225 is disposed on a bottom side of the blocking wall 224 to facilitate fastening.

Figure 5:
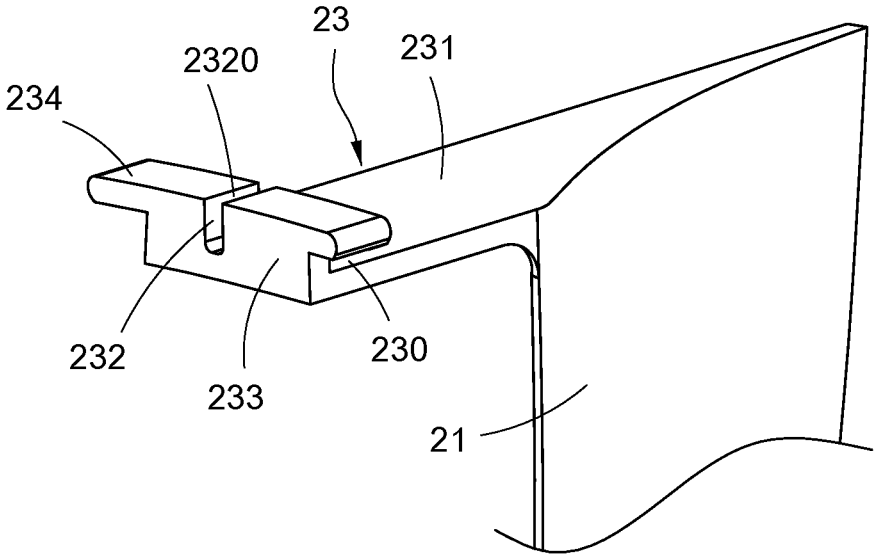
FIG. 5 is a perspective schematic view of the outer coupling plate of the static blade in this disclosure.

Please refer to FIG. 5, which is a perspective schematic view of the outer coupling plate 23 of the static blade 20 in this disclosure. The outer coupling plate 23 includes an outer flap 231 and an outer groove 232. The outer flap 231 is connected to an outer end of the blade body 21 and extends curvedly. The outer groove 232 is disposed on a side of the outer flap 231. The outer flap 231 further includes a linking section 233 and a fastening section 234. The linking section 233 is connected with the outer flap 231 and the fastening section 234. The outer groove 232 extends from the linking section 233 to the fastening section 234, and the outer groove 232 includes an opening 2320 located on the fastening section 234. Additionally, a trough 230 is formed among the outer flap 231, the linking section 233 and the fastening section 234.

Figure 6:
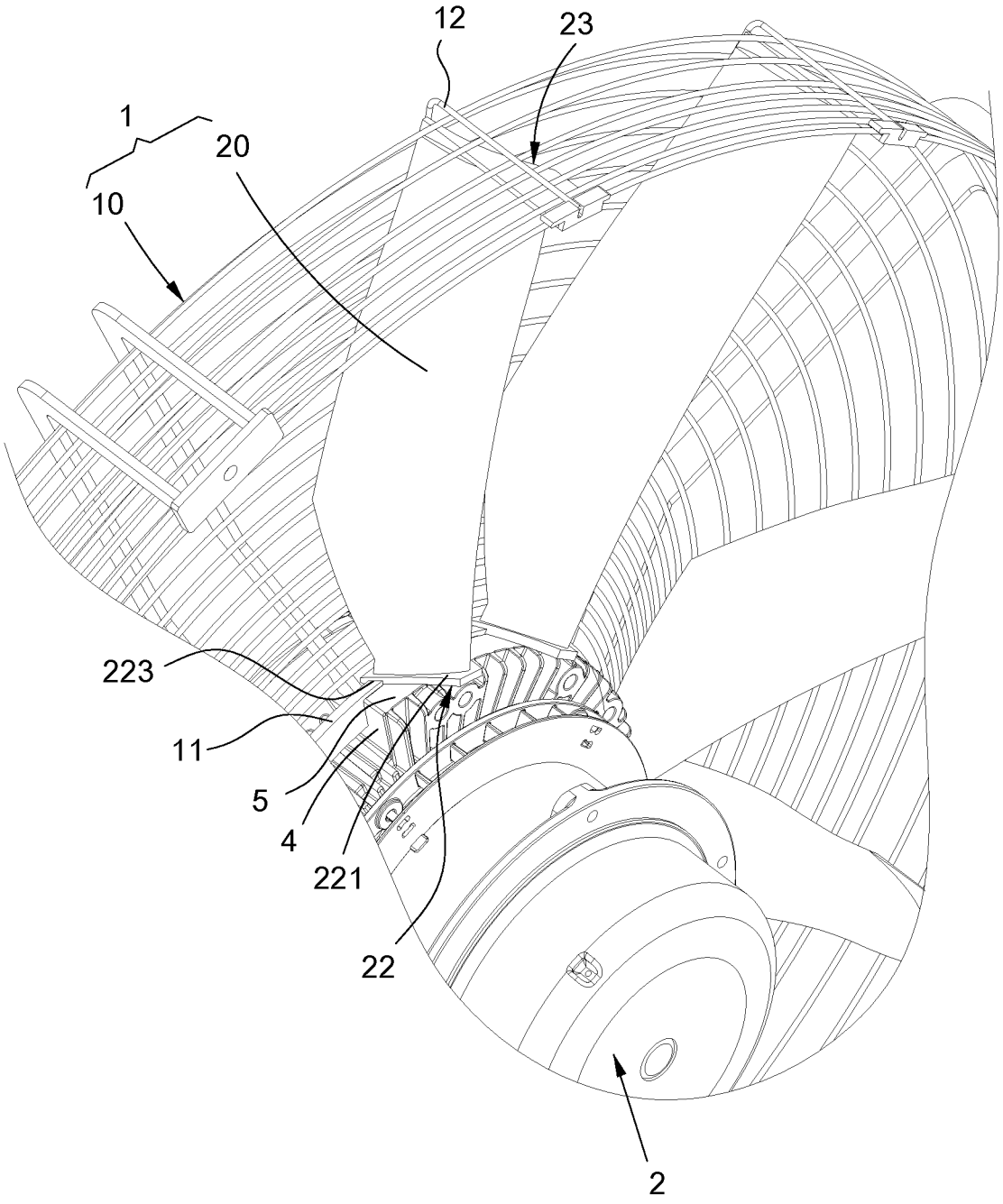
FIG. 6 is a perspective schematic view of another side of the combination structure of a fan guard and static blades in this disclosure.

Please refer to FIG. 6, which is a perspective schematic view of another side of the combination structure of a fan guard 10 and static blades 20 in this disclosure. In this embodiment, the static blade 20 is fixed on one side of the fan guard 10 through the inner coupling plate 22 being combined with one end of one radial rib 12 and through the outer coupling plate 23 being combined with another end of the radial rib 12 oppositely.

It should be noted that the motor 2 includes a motor base 4 and a flange 5 arranged on the periphery of the motor base 4. The annular plate 11 of the fan guard 10 is bonded to the flange 5, and the inner coupling plate 22 of the static blade 20 abuts against the flange 5. Furthermore, the slot 223 is disposed on a side of the inner flap 221 to be engaged with the annular plate 11. The combination of the static blade 20 and the radial rib 12 is described in detail as follows.

Figure 7:
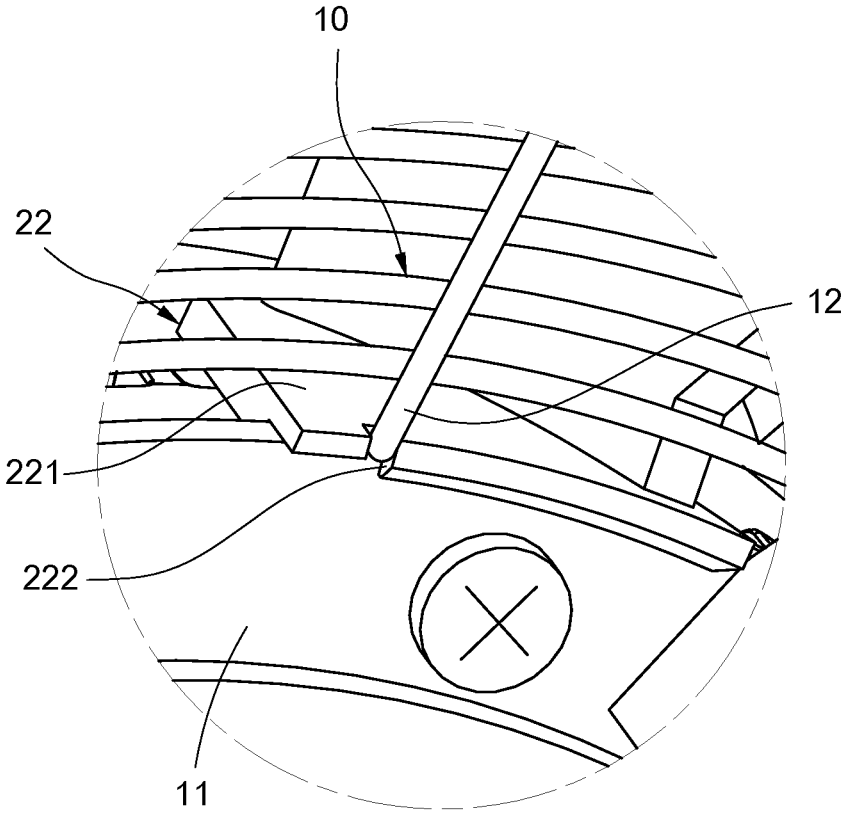
FIG. 7 is a combination schematic view of the inner coupling plate and the radial rib in this disclosure (a partially enlarged view of the part A in FIG. 1).

Please refer to FIG. 7, which is a combination schematic view of the inner coupling plate 22 and the radial ribs 12 in this disclosure. FIG. 7 is a partially enlarged view of the part A in FIG. 1. The inner flap 221 of the static blade 20 abuts against the periphery of the annular plate 11. The inner groove 222 is disposed on a side of the inner flap 221 to be engaged with one end of the radial rib 12. It is worth of noticing that an undercut is disposed on a side of the inner groove 222. Thus, when the radial rib 12 is engaged with the inner groove 222, the undercut disposed on the side of the inner groove 222 abuts against the annular plate 11 to make the static blade 20 be firmly positioned on the fan guard 10 through the radial ribs 12.

Figure 8:
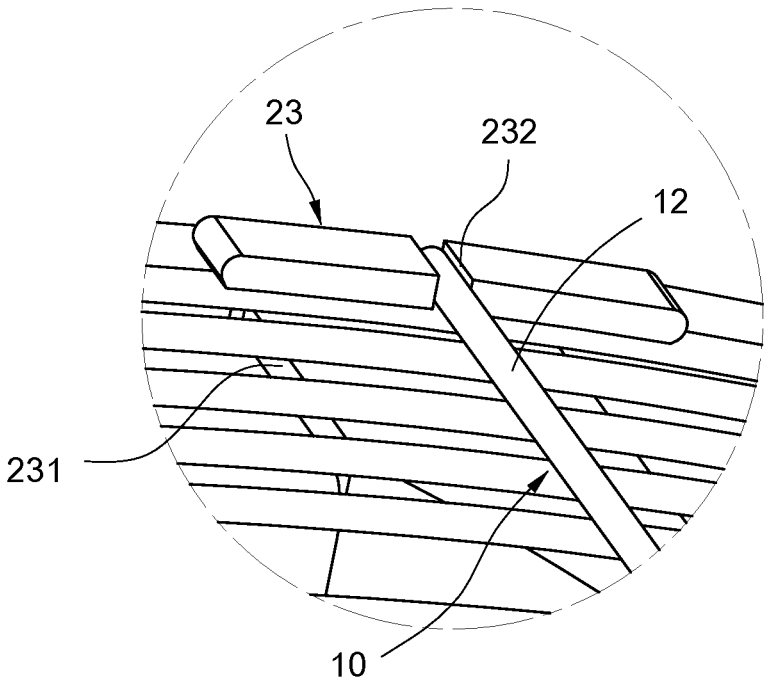
FIG. 8 is a combination schematic view of the outer coupling plate and the radial rib in this disclosure (a partially enlarged view of the part B in FIG. 1).

Please refer to FIG. 8, which is a combination schematic view of the outer coupling plate 23 and the radial ribs 12 in this disclosure. FIG. 8 is a partially enlarged view of the part B in FIG. 1. The outer groove 232 is disposed on a side of the outer flap 231 to be engaged with another end of the above-mentioned radial rib 12 oppositely. Similarly, an undercut is disposed on the outer groove 232. Thus, the radial ribs 12 are engaged with the outer groove 232 without escaping, and the static blade 20 is firmly positioned on the fan guard 10 through the radial ribs 12. Referring to FIGS. 7 and 8, each of the static blades 20 is connected with the fan guard 10 through the corresponding radial rib 12.

Figure 9:
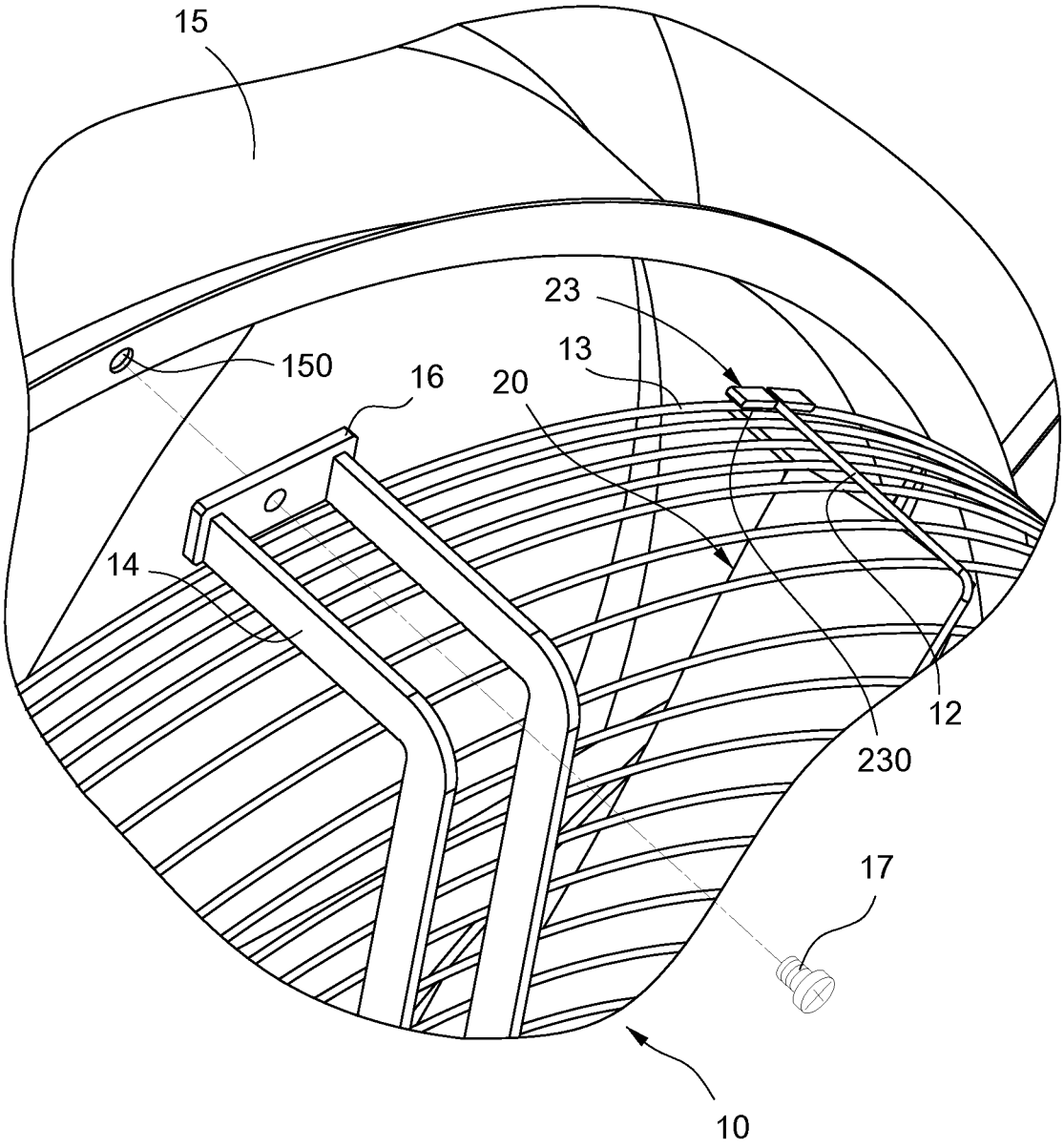
FIG. 9 is a combination schematic view of the supporting rod and the outer frame in this disclosure.

Please refer to FIG. 9, which is a combination schematic view of the supporting rod 14 and the outer frame 15 in this disclosure. In one embodiment of this disclosure, the fan guard 10 further includes a plurality of fixing plates 16 and a plurality of fasteners 17. In this embodiment, the fasteners 17 are screws. Moreover, the supporting rods 14 are arranged in pairs and combined with the fixing plates 16 on the distal ends thereof. On the other hand, the outer frame 15 includes a plurality of fixing holes 150 disposed on the side facing the supporting rods 14. The supporting rods 14 are combined with the outer frame 15 through the fasteners 17 passing through the fixing plates 16 and the fixing holes 150.

The outer coupling plate 23 of the static blade 20 is combined with the radial ribs 12 and engaged with the circumferential rib 13. Specifically, the circumferential rib 13 located at outermost position is engaged in the trough 230 on the end of the outer coupling plate 23.

Figure 10:
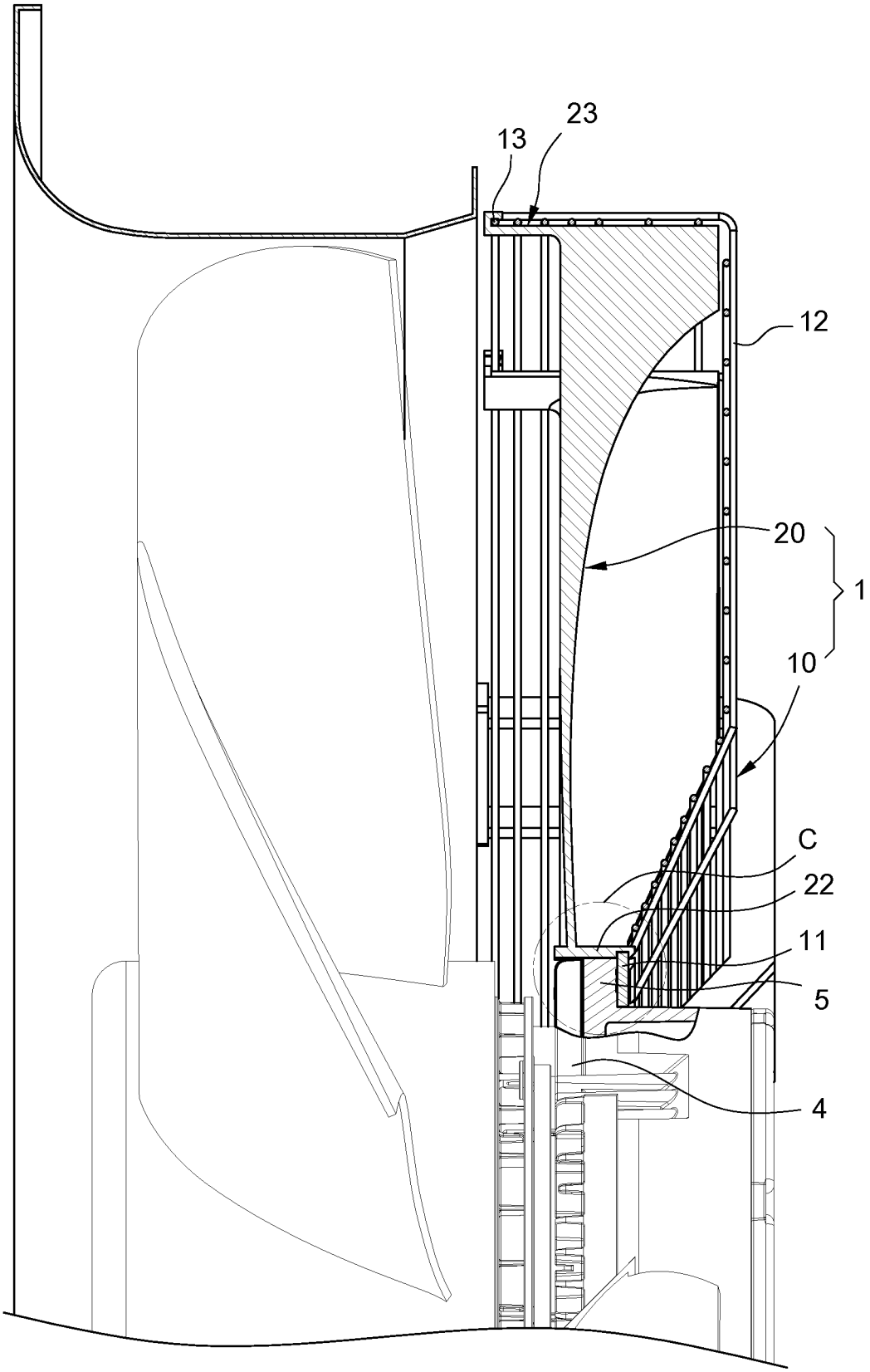
FIG. 10 is an application schematic view of a fan guard and static blades in this disclosure.

Please refer to FIG. 10, which is an application schematic view of a fan guard 10 and static blades 20 in this disclosure. This disclosure is a combination structure 1 of a fan guard 10 and a plurality of static blades 20. The inner coupling plate 22 of the static blade 20 is engaged with the annular plate 11 of the fan guard 10 to be fixed on the flange 5 of the motor base 4. The inner coupling plate 22 and the outer coupling plate 23 located on two ends of the static blade 20 are engaged with two ends of the radial rib 12 respectively to make the static blade 20 be fixed on the fan guard 10. Furthermore, it can be seen from FIG. 10 that the outer coupling plate 23 is further engaged with the outermost circumferential rib 13.

Figure 11:
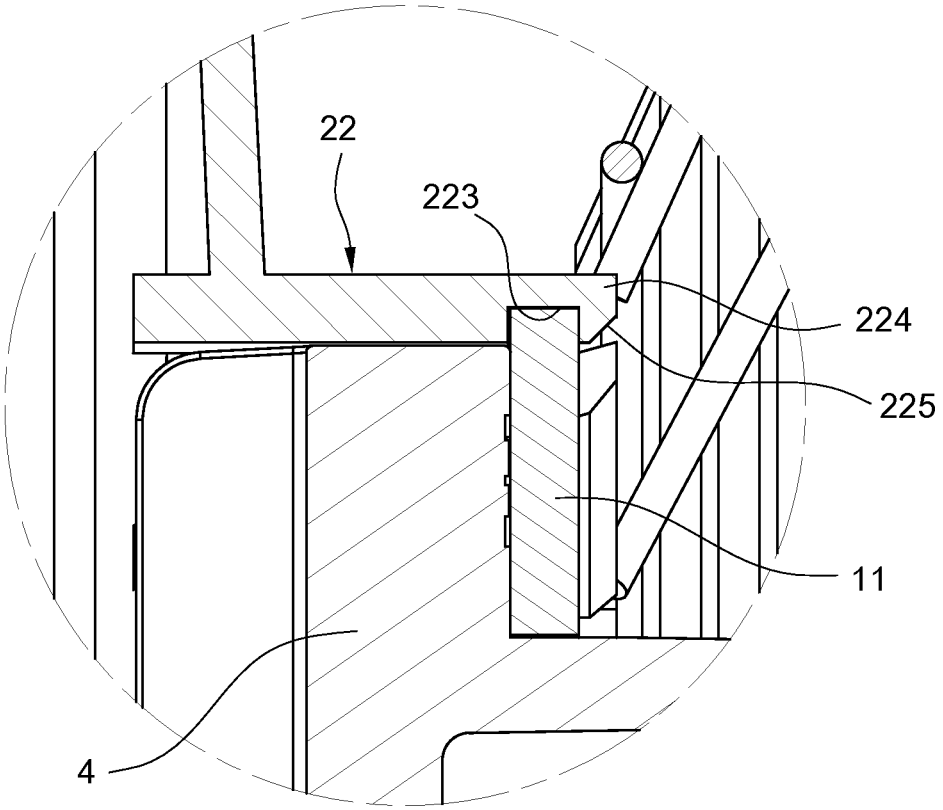
FIG. 11 is a partially enlarged view of the part C in FIG. 10.

Please refer to FIG. 11, which is a partially enlarged view of the part C in FIG. 10. The inner coupling plate 22 abuts against the motor base 4. A slot 223 is disposed on a bottom side of the inner coupling plate 22, and a blocking wall 224 with a chamfer 225 is disposed on a side of the slot 223. The arrangement of the chamfer 225 can facilitate the engagement of the annular plate 11 and the slot 223 when the inner coupling plate 22 slides.

Figure 12:
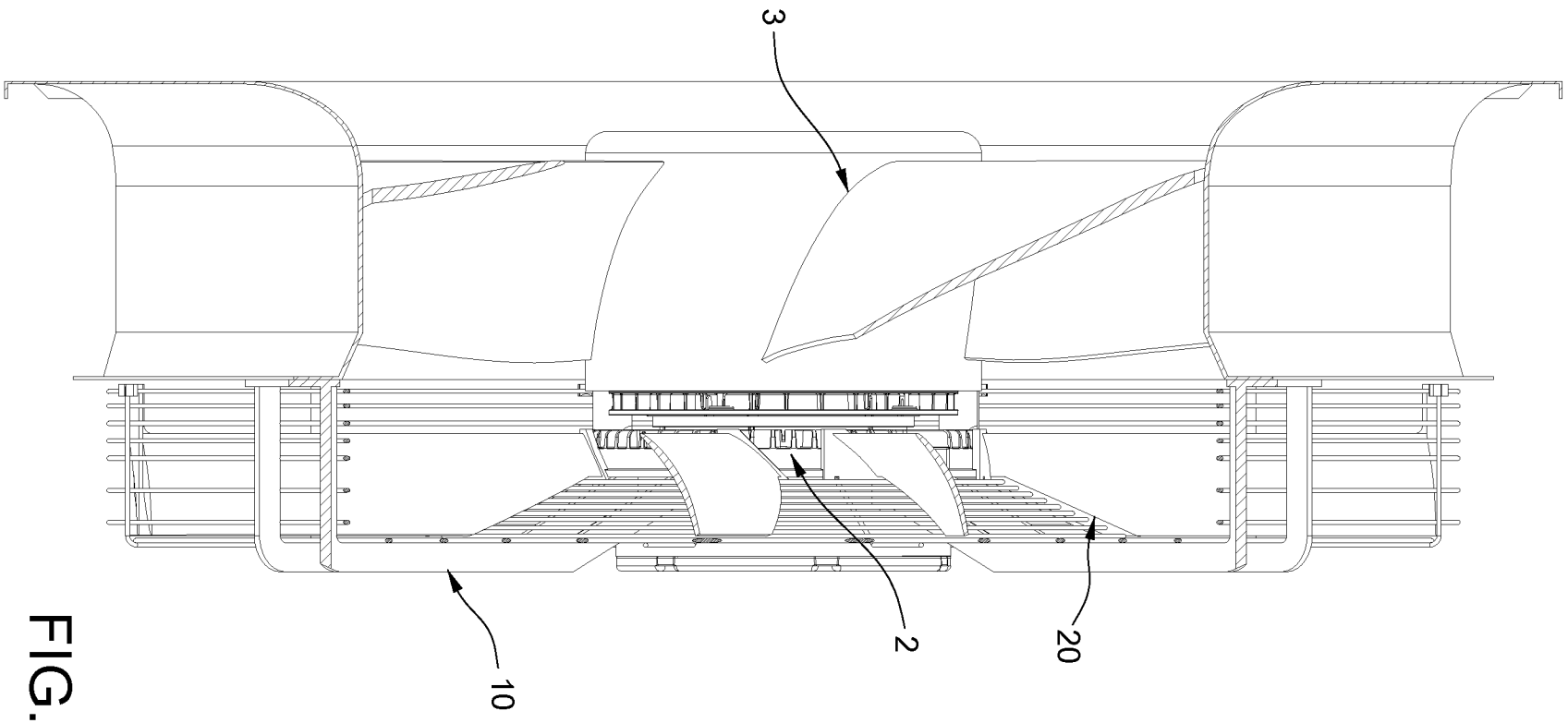
FIG. 12 is an application schematic view of a fan guard and static blades in this disclosure.

Please refer to FIG. 12, which is an application schematic view of a fan guard 10 and static blades 20 in this disclosure. After the fan guard 10 and the static blades 20 of this disclosure are assembled in the aforementioned manner, the fan guard 10 combined with the static blades 20 is arranged on the air outlet side of the impeller 3. By the driving of the motor 2, the efficiency of the impeller 3 is improved through the arrangement of the static blades 20.

Figure 13:
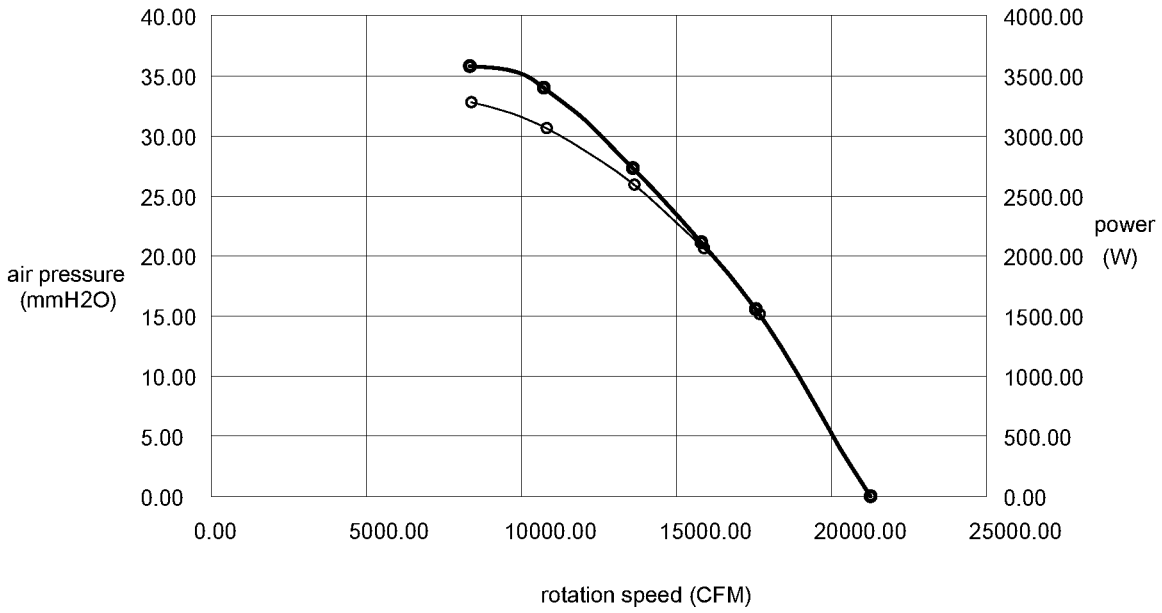
FIG. 13 to FIG. 15 are comparison diagrams of the characteristic curve of the fan device with and without static blades in this disclosure.

Please refer to FIG. 13, which is a comparison diagram of the characteristic curve of the fan device with and without static blades in this disclosure. Under the same air volume and rotation speed, the characteristic curve (represented in the thick line) of the fan device with static blades of this disclosure has a higher air pressure than the characteristic curve (represented in the thin line) of the fan device without static blades.

Figure 14:
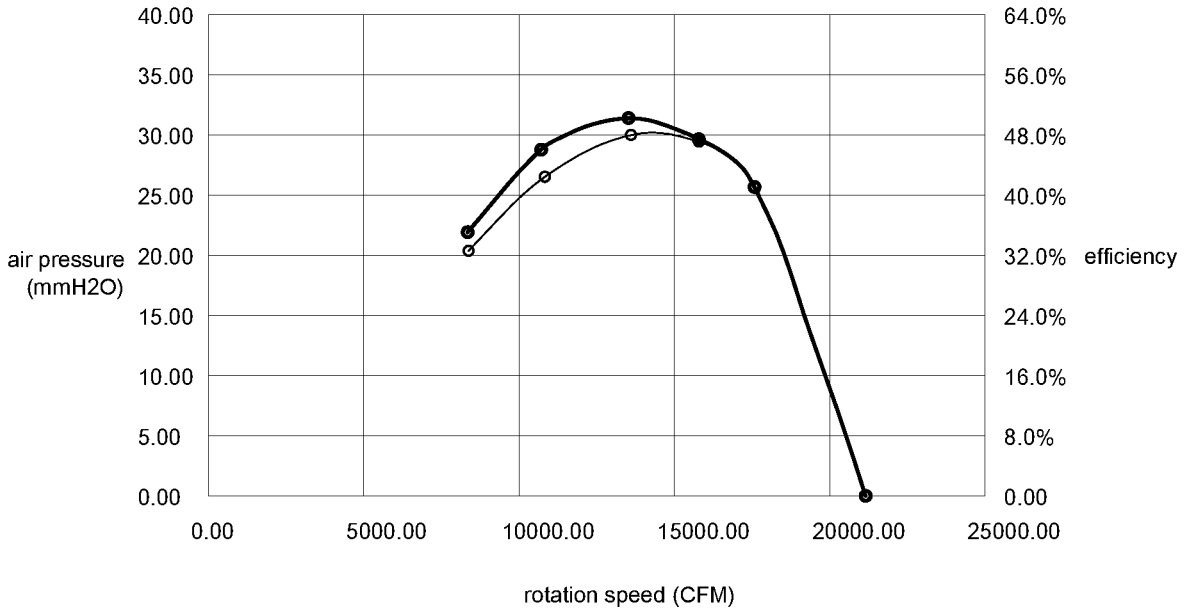

Please refer to FIG. 14, which is a comparison diagram of the characteristic curve of the fan device with and without static blades in this disclosure. Under the same air pressure and rotation speed, the characteristic curve (represented in the thick line) of the fan device with static blades of this disclosure has a higher efficiency than the characteristic curve (represented in the thin line) of the fan device without static blades.

It should be noted that the efficiency is defined as follows.

$$\text{Efficiency} = \frac{\text{air volume } Q(Pa) \times \text{air pressure } P(CMS)}{\text{power factor } PF \times \text{input voltage } (V) \times \text{input current } (A)}$$

It can be seen from the above formula that under the same air volume and air pressure, the fan device with static blades of this disclosure has a lower power consumption.

Figure 15:
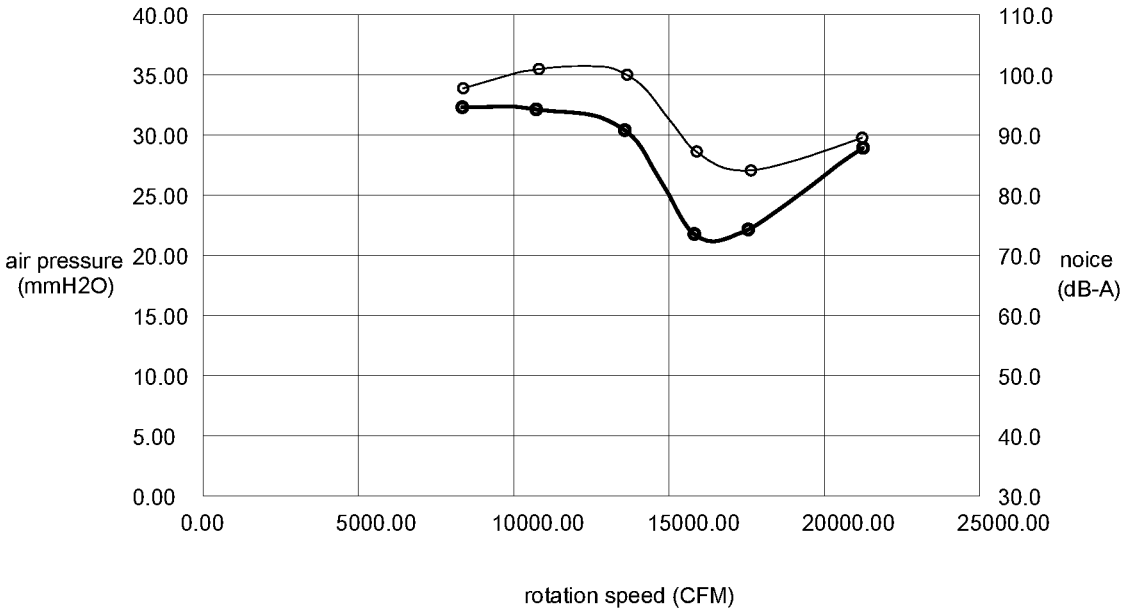

Please further refer to FIG. 15, which is a comparison diagram of the characteristic curve of the fan device with and without static blades in this disclosure. Under the same air pressure and rotation speed, the characteristic curve (represented in the thick line) of the fan device with static blades of this disclosure has lower noise than the characteristic curve (represented in the thin line) of the fan device without static blades.

In summary, comparing the characteristic curve between the fan device provided with static blades of this disclosure and the fan device without static blades, the fan device of this disclosure can provide a higher air pressure and air volume by the same power, and the noise can be avoided when the rotation speed is increased.

While this disclosure has been described by means of specific embodiments, numerous modifications and variations could be made thereto by those skilled in the art without departing from the scope and spirit of this disclosure set forth in the claims.

What is claimed is:

1. A combination structure, comprising:

a fan guard, comprising an annular plate, a plurality of radial ribs and a plurality of circumferential ribs, the annular plate fixed on a motor base, the plurality of radial ribs extending radially and arranged around the annular plate in a radial manner, and the circumferential ribs arranged concentrically and spacedly and connected with the plurality of radial ribs in series; and a plurality of static blades, each of the static blades comprising a blade body, an inner coupling plate and an outer coupling plate, the inner coupling plate and the outer coupling plate arranged on respective end of the blade body, wherein each blade body is fixed on one side of the fan guard through the inner coupling plate being combined with one end of one of the plurality of radial ribs and through the outer coupling plate being combined with another end of the one of the plurality of radial ribs to make the plurality of static blades be combined on the fan guard in the radial manner.

2. The combination structure according to claim 1, wherein the fan guard further comprises an outer frame and a plurality of supporting rods, the outer frame surrounds one side of the plurality of circumferential ribs and connected with ends of the supporting rods, and other ends of the supporting rods are connected with the annular plate.

3. The combination structure according to claim 2, wherein the fan guard further includes a plurality of fixing plates and a plurality of fasteners, the plurality of supporting rods are arranged in pairs and combined with the plurality of fixing plates on distal ends thereof, the outer frame comprises a plurality of fixing holes defined on a side thereof facing the plurality of supporting rods, and the plurality of supporting rods are combined with the outer frame through the plurality of fasteners passing through the plurality of fixing plates and the plurality of fixing holes.

4. The combination structure according to claim 1, wherein the inner coupling plate comprises an inner flap and an inner groove, the inner flap is connected to an inner end of the blade body and extends curvedly, and the inner groove is defined on one side of the inner flap and engaged with a respective end of one of the pluralities of radial ribs.

5. The combination structure according to claim 4, wherein the inner coupling plate further comprises a slot, and the slot is defined on one side of the inner flap and engaged with the annular plate.

6. The combination structure according to claim 5, wherein the inner groove is defined on one side of the slot and communicates with the slot.

7. The combination structure according to claim 5, wherein the inner coupling plate comprises a blocking wall located on a side of the slot, and a chamfer is disposed on a bottom side of the blocking wall.

8. The combination structure according to claim 4, wherein the outer coupling plate comprises an outer flap and an outer groove, the outer flap is connected to an outer end of the blade body and extends curvedly, and the outer groove is defined on one side of the outer flap and engaged with another respective end of the one of the pluralities of radial ribs.

9. The combination structure according to claim 8, wherein the outer coupling plate further comprises a linking section and a fastening section, the linking section is connected with the outer flap and the fastening section, the outer groove extends from the linking section to the fastening section, and the outer groove comprises an opening located on the fastening section.

10. The combination structure according to claim 9, wherein a trough is defined among the outer flap, the linking section and the fastening section, and a circumferential rib located on an outermost position is engaged in the trough.

* * * * *